United States Patent [19]

Tomita et al.

[11] Patent Number: 4,750,915

[45] Date of Patent: Jun. 14, 1988

[54] COMPOSITE WHETSTONE FOR POLISHING SOFT METALS

[75] Inventors: Yoji Tomita; Takesi Sato, both of Ibaraki, Japan

[73] Assignee: Kanebo, Ltd., Tokyo, Japan

[21] Appl. No.: 831,268

[22] Filed: Feb. 20, 1986

[30] Foreign Application Priority Data

Feb. 22, 1985 [JP] Japan ..... 60-32781

[51] Int. Cl.[4] ..... C09K 3/14

[52] U.S. Cl. ..... 51/298; 51/308; 51/309

[58] Field of Search ..... 51/298, 308, 309

[56] References Cited

U.S. PATENT DOCUMENTS

| | | | |
|---|---|---|---|
| 4,350,497 | 9/1982 | Ogman | 51/298 |
| 4,561,863 | 12/1985 | Hashimoto et al. | 51/309 |
| 4,575,384 | 3/1986 | Licht et al. | 51/298 |
| 4,609,380 | 9/1986 | Barnett et al. | 51/298 |
| 4,618,349 | 10/1986 | Hashimoto et al. | 51/298 |

FOREIGN PATENT DOCUMENTS

| | | |
|---|---|---|
| 0022443 | 11/1961 | Japan . |
| 0001898 | 2/1964 | Japan . |

*Primary Examiner*—A Lionel Clingman
*Assistant Examiner*—Willie J. Thompson
*Attorney, Agent, or Firm*—Sherman and Shalloway

[57] ABSTRACT

This invention pertains to a composite whetstone for polishing soft metal plates, such as an aluminium disc, etc., which comprises matrix and fine abrasive particle. The matrix, uniform in structure, is composed of a polyvinyl acetal-based polymer, a hardened product of at least one kind of thermosetting plastic and amorphous silicate, the fine abrasive particle is incorporated into the matrix fixed substantially in close contact with each other in a continuous manner, wherein the superficial hardness (H) of the composite whetstone, measured by a Rockwell hardness tester with a superficial 15-Y scale, and the size (G) of the fine abrasive particle, determined by a classification procedure according to Japanese Industrial Standard (JIS) R-6001, have to satisfy the following relation.

$$-180 \leqq H + G/55 \leqq -50.$$

11 Claims, 1 Drawing Sheet

COMPOSITE WHETSTONE FOR POLISHING SOFT METALS

FIELD OF THE INVENTION

This invention relates to a composite whetstone for grinding or polishing soft metal plates with a flat surface, such as an aluminium alloy disc to be finished into a magnetic disc (hereinafter referred to as aluminium disc).

DESCRIPTION OF THE PRIOR ART

Conventionally, comparatively soft metal plates with flat surface, such as an aluminium disc and the like are mechanically finished by a precision lathe, a lapping machine, a resinoid type whetstone, a polyurethane type whetstone or other synthetic composite whetstones.

In the mechanical finishing by a precision lathe, however, the accuracy in finished products and the working efficiency depend heavily on workers' skill; besides, their finishing is almost always insufficient. Moreover, when a lot of small products have to be polished, the problem lies in the low working efficiency in the process.

In the case of the lapping process employing a slurry of powdered polishing abrasive, such as silicon carbide, etc., such large quantity of slurry is needed that not only is the process uneconomical, but abrasive particles pollute the air in workshops and spoil the health of workers. Additionally, it unavoidably takes very much trouble and cost to dispose a spent solution enriched with abrasive particles.

In place of the lapping process employing a slurry of powdered polishing abrasive, a polishing process by means of composite whetstones recently prevails on the industry. Generally, however, with vitrified type or resinoid type whetstones polishing power is insufficient and good accuracy in finished product cannot be desired; also, on account of the fact that the grain of the whetstones tends to badly be choked with scums from the whetstones and a product under polishing, it is difficult for them to constantly keep their capacity at their best. To put it in more detail, where there are required accuracy and flatness in finished products at the same time, polishing has to be carried out at one stretch while a whetstone and an article to be polished are being kept in close contact with each other. For this, when a resinoid type or a polyurethane type composite whetstone is employed, their pores on surface tend to be choked with polishing scums because the pores are detached from one to another. Therefore, good polishing does not last so long that frequent dressing (renewal of the whetstone surface) has to be made. In contrast to this, a whetstone employing a polyvinyl acetal-based resin as a binder is known to the public for its superiority because it has continuous pores over the structure which allow scums from the whetstone itself and an article under polishing to get out therethrough. For all its advantage, on account of its comparatively inferior water-resistance, the whetstone is not suitable for precise polishing.

To improve such inferiority in water-resistance, whetstones blended with the thermosetting plastics have been proposed by Japanese Patent Publications No. 1898/1964 and No. 6752/1978, for example. It is said that, according to the latter, a variety of whetstones different in hardness, those from elastic to hard ones, are able to be produced by changing the amount of thermosetting plastics to be blended. Among the whetstones, the one with fine abrasive particles is said to be versatile for polishing soft, hard or hard-to-process metals, but its finish is not yet sufficient. In view of this, it may be said that there are not yet any useful composite whetstones suitable for precise polishing of soft metal plates with comparatively large surface, especially, polishing such as aluminium disc as the present invention aims at.

Other than the above, disclosed in Japanese Patent Publication No. 22443/1961 is a method of incorporating silica gel into a polyvinyl acetal-based matrix for the sake of improving chemical- and pressure-resistance, as well as enhancing the adhesion and the retainability of abrasive particle to the matrix. However, as long as our test is concerned, it cannot be said as well that the composite whetstone according to this process is suitable for precise polishing of soft metal plates.

SUMMARY OF THE INVENTION

Under the circumstances, the present inventors have made an intensive study to eliminate all the above-mentioned drawbacks and finally accomplished the invention.

Accordingly, it is an object of this invention to provide a composite whetstone enabling us to precisely and efficiently polish soft metal plates, such as an aluminium disc, especially a special aluminium alloy disc which is put to a very delicate end use. It is another object of this invention to provide a composite whetstone excellent in polishing power and wear-resistance, as well as suitable for giving an aluminium disc a very accurate finish. It is still another object of this invention to provide a composite whetstone suitable for a precise planar polishing process and constantly bringing out its superior capacity especially in the use associated with a double-surface lapping polisher.

DETAILED DESCRIPTION OF THE INVENTION

Figure 1:
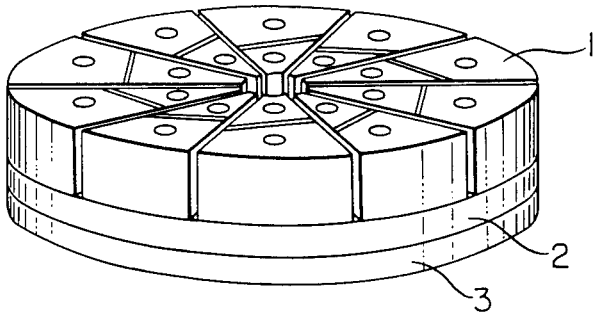
FIG. 1 is a perspective view showing a lapping plate mounted on a lapping polisher, which is given to illustrate how the whetstone of this invention is used.

All the objects mentioned above can be accomplished by a composite whetstone for polishing soft metals comprising matrix and fine abrasive particle, which is characterized in that said matrix forms a three-dimensional network structure with continuous fine voids and is composed uniformly of a polyvinyl acetal-based polymer, a hardened product of at least one kind of thermosetting plastic and amorphous silicate, said fine abrasive particle is incorporated into said matrix fixed substantially in close contact with each other in a continuous manner, and the superficial hardness (H) of said composite whetstone and the size (G) of said fine abrasive particle satisfy a relation $$-180 \leqq H + G/55 \leqq -50,$$

where H is a value obtained from the measurement by a Rockwell hardness tester with the superficial 15-Y scale and G is a value obtained from the classification according to Japanese Industrial Standard (JIS) R-6001.

In polishing soft metal plates, such as an aluminium disc, which is the objective of this invention, it is required to uniformly make a narrow shave over the entire surface and always keep the accuracy in finished products above a certain level. Such polishing has to be made at one stretch with a composite whetstone kept in close contact with a disc to be polished in the presence of a polishing fluid. Therefore, it is required for a composite whetstone to be not only excellent in polishing power and accurate finishing but also always free from being choked with scums from both the whetstone itself and the disc. In addition, from the economical point of view, it is desired that a composite whetstone is as wear-resistant as possible.

With regard to the above, the inventors summarized the requirement for accomplishing their objective in four items as follows:

(a) Matrix of composite whetstone has to have a three dimensional fine network structure.

(b) Polyvinyl acetal-based polymer, a hardened product of at least one kind of thermosetting plastic and amorphous silicate are to be used as a binder for abrasive particle in conjunction.

(c) Fine abrasive particle has to be present in matrix kept in close contact with each other in a continuous manner.

(d) The hardness (H) of a composite whetstone and the size (G) of fine abrasive particle have to satisfy a relation $$-180 \leqq H + G/55 \leqq -50.$$

Among other things, in order to increase polishing capacity, it is of critical importance to use amorphous silicate in association therewith.

Matrix of this invention, having a three dimensional fine network structure, is different from resinoid type and polyurethane type whetstones containing detached small pores therein. That is, detached pores do not exist but continuous, branched fine hollow paths fill in the matrix of this invention, indefinitely communicating with each other. Hence, scums from the whetstone and a disc under polishing are allowed to pass through the paths and hardly clog the same as they do detached pores even if they are caught. Composite whetstones having detached pores in their matrix structure soon decline their polishing power due to clogging, so dressing (renewal of their surface) has to be conducted frequently. In order for the paths not to be clogged with scums from the whetstone and a disc under polishing, their diameter is desirable to be in the range from 10 to 100 μm. That is because when it is smaller than this range, clogging tends to happen and when it is greater than it, the matrix network structure becomes too coarse so that uniform mechanical properties cannot be desired.

Moreover, the porosity is desired to be in the range between 60 and 85% by volume based on the whole matrix volume. When it is smaller than this range, more detached pores tend to appear; when it is greater than it, the matrix becomes a little insufficient in strength.

The reason for employing a polyvinyl acetal-based polymer, a hardened product of at least one kind of thermosetting plastic and amorphous silicate as a binder for an abrasive particle comes from the fact that they can compensate for conventional drawbacks: insufficient water-resistance, poor hardness and improperness to precise planar polishing. As mentioned earlier, a water-resistant matrix composed of polyvinyl acetal-based polymer and a hardened product of thermosetting plastics is well known to those skilled in the art by itself. But why amorphous silicate is mixed as a third component stems from the fact that it can give the composite whetstone a desirable polishing capacity, reduce its wearing and prevent it from being choked with scums from both the whetstone and a soft metal disc under polishing. In matrix of the composite whetstone of this invention, by blending a polyvinyl acetal-based polymer and a hardened product of at least one kind of thermosetting plastic with amorphous silicate, tenacity unique in conventional composite whetstones is decreased, appropriate fragility is added and polishing capacity is increased.

The amount of amorphous silicate based on the weight of the matrix is preferable to be in the range between 0.1 and 10% by weight. When it is less than 0.1% by weight, desired properties originating from amorphous silicate does not appear; when it is greater than 10% by weight, it hardly forms a uniformly blended phase both to polyvinyl acetal-based polymer and a hardened product of thermosetting plastics; as a result, an isolated phase composed mainly of amorphous silicate appears in part in a granular form, which occasionally becomes a cause of leaving scratches on a metal disc under polishing, so that overdosing of amorphous silicate should be avoided with care.

Meanwhile, the term "amorphous silicate", as the term is employed herein, refers to a gel-like substance produced by adding acid to a variety of silicates formed between silicon dioxide and various bases. Among the silicates are those represented by the general formula $Na_2O.xSiO_2.yH_2O$ in the case that soda ash is employed as a base, wherein the molar ratio of $Na_2O$ to $SiO_2$ is desired to be 2, 3 or 4. In this respect, the gel-like substance, an inorganic polymer, whose general formula is represented by

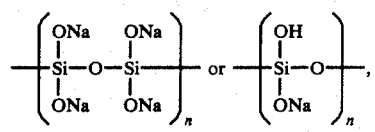

plays a role of an intermolecular crosslinking agent to build up a three dimensional network structure. Aluminium hydroxide, etc. can also be used as a base other than soda ash.

Matrix plays a role of firmly holding fine abrasive particles. During polishing, when some particle wears off, another comes out on the surface as matrix wears down in the course of polishing. However, the matrix of this invention is comparatively hard to wear down because it is blended with amorphous silicate; on account of that, polishing capacity is improved very much. As a matter of course, just using amorphous silicate is not sufficient to achieve the improvement in polishing capacity. It is equally important for abrasive particle to be mixed in the matrix so as to be in close contact with each other like forming a piece of string. That is, only when all the above requirements are satisfied, there forms a composite whetstone suitable for polishing soft metal plates which this invention aims at.

What next counts in this invention is concerned with a way of distributing abrasive particle in matrix. In a conventional whetstone of this kind, abrasive particle on the surface sporadically wears off one after another and disappears as matrix wears down gradually. In that process, however, since the matrix contains less abrasive particle than the matrix of this invention and the abrasive particle is isolatedly scattered therein, the matrix originally having no polishing power has to wholly share polishing here and there where one particle has worn off; as a result, polishing power becomes decreased, which is of course undesirable especially when soft metal plates, such as an aluminium disc, etc., have to be finished like a mirror because there tend to appear unevenness in flatness on the surface.

As far as this invention is concerned, in order to avoid these undesirable results, abrasive particle is not isolated from each other, but distributed substantially in a continuous manner with one kept in close contact with another. Such desirable arrangement originates from the fact that there are countless three-dimensionally communicating continuous hollow paths in matrix, which share 60–85% of the whole matrix by volume and are 10–100 μm in diameter; thus enough abrasive particle can deposit on them with substantially no gap.

In order to assure such desirable distribution, the grade of the abrasive particle needs to be at least #800 and the content of the abrasive particle is not less than 25% by weight; more preferably, it is not less than 35% by weight based upon the weight of the whole matrix.

Furthermore, to meet the requirement of this invention, the superficial hardness (H) of the composite whetstone, measured by a Rockwell hardness tester with the superficial 15-Y scale, and the abrasive particle size (G), classified according to Japanese Industrial Standard (JIS) R-6001, have to satisfy the following relation.

$$-180 \leqq H + G/55 \leqq -50$$

Concretely, the grade and the scattering of the mean sized particle corresponding thereto are shown as follows.

| Grade | #800 | #1000 | #1200 | #1500 | #2000 | #2500 | #3000 |
|---|---|---|---|---|---|---|---|
| Scattering | 22–18μ | 18–14.5μ | 14.5–11.5μ | 11.5–8.9μ | 8.9–7.1μ | 7.1–5.9μ | 5.9–4.7μ |

When (H+G/55) is smaller than the lower limit of the above equation, the polishing power becomes inferior.

When (H+G/55) is greater than the upper limit of the above equation, the hardness and the tenacity of the composite whetstone become so too high that the grain of the whetstone tends to be choked with scums from the whetstone itself and a soft metal disc under polishing, with the result that such good performance as this invention aims at is hard to bring out.

As best seen from the above equation, the lower the grade of the abrasive particle, i.e. the larger the size of the abrasive particle, the harder the composite whetstone should be made.

The composite whetstone of this invention is manufactured according to the following process. First of all, one or more than one kinds of polymers selected from the group consisting of polyvinyl alcohol whose mean polymerization degree is present between 300 and 2,000 and whose saponification number is less than or equal to 80 mol.%, a derived polymer and a modified polymer therefrom are put in water to make up a primary mixture solution. An aqueous/non-aqueous solution or an emulsion of thermosetting plastic precursors comprising monomers, oligomers or polymers thereof and an aqueous/colloidal solution of silicate are added to the above primary mixture solution uniformly with stirring. Furthermore, an abrasive particle, an aldehyde as a cross-linking agent, an acid as a catalyser and starch or the like which serves to form continuous hollow paths in the matrix, are added thereto. A slurry with uniform viscosity is prepared therefrom, which is put in a mold with desired shape and permitted to solidify by being kept standing in a warm water-bath or any other baths at 40°–100° C. for about 24 hours. After that, extra aldehyde, acid, starch, etc. are removed by rinsing in water. Although looking like a finished composite whetstone, a semi-product thus prepared is still insufficient in desired properties because the thermosetting reaction does not complete in the resin yet. Therefore, the semi-finished product has to undergo a curing process after heated previously at about 100° C. to remove moisture and dried. The temperature and the time required for the curing process are not definitely decided because these factors have to be varied delicately with the kind and the amount of a resin used. However, the curing can almost be accomplished when a resin is kept standing at 100°–250° C. for 20–100 hours.

In this respect, when curing is made insufficiently, the tenacity of a resin becomes increased; reversely when the curing condition is too strong and a resin has become too hard as a result of that, the thermal decomposition tends to take place in a resin, together with the thermosetting reaction, which sometimes follows undesirable result, so that choosing the curing condition should be made carefully. Other than that, in order to avoid a rapid rise in temperature during curing; temperature should be raised stepwise, in order to control partial oxidation or thermal deterioration likely to occur in a resin, curing should be carried out in an inert gas. Except for polyvinyl alcohol, thermosetting plastic precursors available for this invention may be premixed as mentioned above when a material mixture solution is prepared. Also, a semi-product having undergone the primary thermosetting reaction may be impregnated with liquid thermosetting plastic precursors and then put to the curing process. Moreover, in the case that more than one kinds of thermosetting precursors are mixed, it is possible that one is premixed and the other is added thereafter before the second heat-treatment. Like this, there is no definite way in particular in blending thermosetting resin precursors. In connection with this, it is sometimes effective to incorporate catalysts in association therewith to prompt the thermosetting reaction.

Liquid thermosetting plastic precursors can be employed in the form of an aqueous solution, non-aqueous solution or emulsion; other than that, they can be used as they stand without mixing into any solvent. Considering the easiness of handling in a working place and controlling their composition, employing their aqueous solution may be the most preferable of all.

The term "fine abrasive particles", as the term is employed herein, refers to any one of chemical compounds and elements having polishing or grinding power, such as diamond, boron nitride, silicon carbide, fused alumina, garnet, emery, cerium oxide, chromium oxide, etc. which is powdered and classified according to JIS R-6001. In order to accomplish the objects of this invention, it is desirable in particular to use at least one kind of abrasive particle selected from the group consisting of silicon carbide, fused alumina, chromium oxide and cerium oxide.

A composite whetstone manufactured in this way is shaped into a desired form and used to polish the surface of soft metal plates. Particularly in the event that a special aluminium alloy disc is polished with the composite whetstone into desired thickness and flatness with highest accuracy, the composite whetstone is desirable to be mounted on precise polishing devices, such as a double-surface lapping machine because it is originally designed to finish such very even, flat surface that it is not compatible with common polishing machines. Meanwhile, a double-surface lapping polisher refers to a polishing machine provided with two circular or ring metal plates designed to turn in opposite direction to each other, whereby one or more sheets of discs can be put between them compressed and polished with lap by their frictional rotation. When the composite whetstone is used in conjunction with a double-surface lapping polisher, it is mounted on both the metal plates so that its surface can give accurate parallelism to a disc to be polished. During operation a proper amount of polishing fluid is applied to wet a portion under polishing. Water containing or not containing surfactants or organic solvents is used as a polishing fluid.

When the whetstone of this invention is mounted on a double-surface lapping polisher to finish an aluminium disc, for example, as mentioned above, the fine abrasive particle, incorporated into the matrix with excellent water-resistance and retainability for the particle and fixed substantially in close contact with each other in a continuous manner, brings out its ever fresh and sharp polishing capacity in cooperation with proper hardness, elasticity and fragility of the matrix. The abrasive surface of the composite whetstone is always renewed by itself because new abrasive particle appears thereon one after another whenever the worn-off one comes off therefrom. Furthermore, the never-declining polishing power is assured since the grain of the composite whetstone is never choked with scums coming off from the whetstone itself and a metal disc under polishing because they are easily exhausted to the outside, permitted to pass through countless continuous fine paths three-dimensionally prevailing over the entire inside of the matrix. In a conventional composite whetstone of this kind, microscopically speaking, matrix sometimes has to wholly share polishing here and there where some abrasive particle has worn off until the next one appears there as the matrix wears down by and because matrix contains less particle than the matrix of this invention and abrasive particle is not so desirably distributed in a continuous manner as the abrasive particle of this invention. In this invention, however, all such drawbacks are eliminated that uniform polishing can always be made over the entire surface of soft metal plates, with the result that a precisely-finished product with no scratch on surface and no unevenness in thickness appears efficiently.

This invention will be understood more readily in reference to the following examples; however, these examples are intended to illustrate this invention and not to be construed to limit the scope of the invention.

EXAMPLE

A polishing apparatus, measurement instruments and a metal plate (specimen) subjected to polishing in this example are listed as follows:

*Polishing apparatus:
Double-surface lapping polisher, a product of Speedfam Co., Ltd. (Type SFDL 9B-5 SSG)
*Surface roughness tester:
a product of Tokyo Seimitsu Co., Ltd. (Type Surfcom 553 A)
*Binding strength tester:
a product of Tokyo Koki Co., Ltd.
*Hardness tester:
a product of Matsuzawa Seiki Co., Ltd.
*Specimen:
Aluminium alloy ring plate (Alloy No. 5086) made according to JIS H-4000

Polishing and measurement conditions are as follows:

*Contact pressure:
100 g/cm$^2$
*Polishing time:
3 mins./batch
*Upper polishing plate rotation:
20 rpm (counterclockwise)
*Lower polishing plate rotation:
60 rpm (clockwise)
*Carrier plate rotation:
20 rpm (clockwise)
*Feed rate of polishing water:
5 l/min.

Condition in measurement of surface accuracy:

$$\begin{pmatrix} Ra \\ Rmax \end{pmatrix} \begin{matrix} * \text{ Cutoff value} \ldots \geqq 0.8 \text{ mm} \\ * \text{Measurement length} \ldots 2.5 \text{ mm} \end{matrix}$$

$$(W_{CM}) \begin{matrix} * \text{ Cutoff value} \ldots \leqq 0.8 \text{ mm} \\ * \text{Measurement length} \ldots 80 \text{ mm} \end{matrix}$$

In the above, Ra, Rmax and $W_{CM}$ stand for parameters in the following equation.

Ra . . . Center line average roughness $$Ra = \frac{1}{L} \int_0^L |f(x)|\,dx$$

f(x) . . . Roughness curve (function of the degree of surface finish)

Rmax . . . Maximum height $$Rmax = Pmax - Vmin$$

Pmax . . . Height of the highest peak in f(x)
Vmin . . . Depth of the deepest base in f(x)

$W_{CM}$ . . . Maximum swell of filtered wave
Pmax . . . Height of the highest peak in the swell of filtered wave
Vmin . . . Depth of the deepest base in the swell of filtered wave Condition in measurement of superficial hardness:

Scale used:
Rockwell superficial 15-Y scale
Load:
1.5 kg
Ball used:
½" steel ball Condition in measurement of binding strength:
Load:
10 kg
Procedure:
JIS R-6240
Two grades of powdered silicon carbide (#1000 and #2000) are used as an abrasive particle. The former has a mean sized particle in 14.5–18.0 μm and the latter has a mean sized particle in 7.1–8.9 μm. A completely saponified polyvinyl alcohol with $\overline{DP}$ of 1700 is dissolved in water. A slurry is prepared by adding a water-soluble phenol resin (Type PR-961A, produced by Sumitomo Bakelite Co., Ltd.), sulfuric acid as a catalyser, formaldehyde as a cross-linking agent, corn starch as a void-forming agent and silicate made from silicon dioxide and soda ash to the polyvinyl alcohol aqueous solution. The slurry is poured into a mold with desired shape and permitted to solidify at 60° C. for 24 hours. After that, excessive sulfuric acid, formaldehyde, corn starch and others are removed by rinsing in water. A semi-product of a composite whetstone is formed after drying, which is then put to heat-treatment at 130° C. for about 50 hours to complete the thermosetting reaction. A primary composite whetstone is thus produced. Separately, a melamine resin aqueous solution is prepared by adding a melamine resin (a product of Showa Kobunshi Co., Ltd., Type SM 700) to water. The primary composite whetstone is soaked in the melamine resin aqueous solution. After a certain amount of the melamine resin aqueous solution is squeezed out of the primary composite whetstone, it is dried, heated at 130° C. for about 50 hours and finally made up to an objective composite whetstone.

The composition of the composite whetstone is shown in Table 1. The composite whetstone thus produced is cut into segments 1 as shown in FIG. 1. They are put on a metal plate 2 and secured to upper and lower lapping plates 3 with bolts. A polishing specimen is fixed with a carrier and polishing is made in a certain condition while water is being applied to the specimen as a polishing fluid or coolant. After a prescribed time, the surface condition of the specimens is scrutinized. Separately, on purpose to see if the surface of the composite whetstone would be choked with scums coming off from the composite whetstone and the specimen after long polishing, fifteen batches of polishing are carried out continuously without dressing it. The surface condition of both the specimens and the composite whetstone is given in Table 1.

TABLE 1

| Grade (Mean Particle Size) | | | #1000 (14.5–18 μm) | | | | | | #2000 (7.1–8.9 μm) | | |
|---|---|---|---|---|---|---|---|---|---|---|---|
| | Experiment No. | | 1 | 2 | 3 | 4 | 5 | 6 | 7 | 8 | 9 |
| Composition (wt %) | Polyvinyl acetal resin | | 18.6 | 18.8 | 18.6 | 16.5 | 16.0 | 18.9 | 22.0 | 21.1 | 21.1 |
| | Phenol resin | | 5.3 | 4.0 | 1.3 | 1.0 | 1.2 | 12.1 | 12.5 | 0.7 | 5.2 |
| | Silicate | | 0 | 0.2 | 4.0 | 8.7 | 10.5 | 8.0 | 4.7 | 4.5 | 0 |
| | Melamine resin | | 15.3 | 15.5 | 15.3 | 14.6 | 13.5 | 0 | 0 | 15.3 | 15.3 |
| | Abrasive particle | | 60.8 | 61.5 | 60.8 | 59.2 | 58.8 | 61.0 | 60.8 | 58.4 | 58.4 |
| Physical Properties | Porosity (vol. %) | | 70 | 72 | 70 | 70 | 70 | 71 | 76 | 74 | 74 |
| | Mean void dia. (μm) | | 25 | 25 | 25 | 25 | 23 | 25 | 25 | 25 | 25 |
| | Rockwell hardness | | −215 | −190 | −155 | −150 | −143 | −225 | −220 | −152 | −180 |
| | Binding Strength (1/100 mm) | | 40 | 40 | 36 | 32 | 33 | 45 | 42 | 33 | 35 |
| 1 batch polishing test | Polishing rate (μm/min.) | | 30 | 33 | 32 | 38 | 37 | 30 | 22 | 27 | 20 |
| | Surface roughness | Ra (μm) | 0.10 | 0.11 | 0.11 | 0.11 | 0.11 | 0.10 | 0.06 | 0.05 | 0.05 |
| | | Rmax (μm) | 0.98 | 1.12 | 1.08 | 1.35 | 1.66 | 1.03 | 0.62 | 0.55 | 0.51 |
| | | $W_{CM}$ (μm) | 3.3 | 3.0 | 2.2 | 2.9 | 2.7 | 4.4 | 3.7 | 3.6 | 4.0 |
| | Scratch | | − | − | − | − | + | − | − | − | − |
| 15 batch continuous polishing test | Polishing rate (μm/min.) | | 20 | 27 | 35 | 36 | 38 | 28 | 18 | 26 | 16 |
| | Surface roughness | Ra (μm) | 0.10 | 0.10 | 0.12 | 0.12 | 0.12 | 0.11 | 0.06 | 0.05 | 0.05 |
| | | Rmax (μm) | 1.35 | 1.38 | 1.05 | 1.51 | 1.86 | 1.10 | 0.61 | 0.56 | 0.53 |
| | | $W_{CM}$ (μm) | 4.8 | 3.8 | 2.3 | 2.9 | 2.9 | 4.1 | 4.0 | 3.5 | 4.3 |
| | Scratch | | − | − | − | + | ++ | − | − | − | − |
| | Choking | | + | + | − | − | − | − | − | − | + |
| | Wearing of whetstones | | 46 | 42 | 29 | 27 | 25 | 35 | 18 | 15 | 20 |

(N.B.)
− invisible
+ slightly visible
++ clearly visible

It becomes obvious from Table 1 that every composite whetstone of this invention has a proper polishing power and can give a good result in the surface finish. It also becomes clear that there are very few scratches on the finished products when Rmax is about 10–12 times as large as Ra. In short, those produced in the scope of this invention are excellent in the durability of polishing power; in other words, they do not lose their polishing power even after continuous 15 batches of polishing. In contrast to this, those produced out of the scope of this invention, for example, such composite whetstones containing no silicate as those in Experiments No. 1 and No. 9 noticeably decline their polishing power and easily wear down; besides, the flatness ($W_{CM}$) of finished plates is bad. Likewise, such composite whetstones containing excessive silicate as those in Experiment No. 5 are found to have an aggregation of pure amorphous silicate; therefore, Rmax increases to about 15 times as large as Ra, which shows there are noticed deep scratches on finished products. Furthermore, such composite whetstones containing only phenol resin as a thermosetting plastic like those in Experiments No. 6 and No. 7 is slightly inferior to those containing melamine resin in addition thereto in polishing power, but there is no particular problem with the durability of polishing power and the accuracy in finished products.

Since the accuracy in finished products decreases with the decrease in polishing power in conventional composite whetstones, dressing (surface renewal of whetstones) has to be made again in a comparatively short period of time, but such great improvement is made by this invention that economical loss due to idle time for the purpose of dressing can be eliminated. Moreover, with the increase in quality stability, the output of finished products has actually increased. In view of all such effect, the economical advantage is unfathomable indeed. Now that the composite whetstone of this invention does not need frequent dressing and becomes much more wear-resistant, its life in actual working has been prolonged very much; in other words, the number of soft metal plates to be finished with a set of the composite whetstone has increased. Besides, the increased polishing power has reduced the time required for one batch of polishing, with the result that improvement in working efficiency has come to be very expectable.

This invention has thus made it possible to finish soft metal plates, such as an aluminium disc, with exact flatness and high accuracy in an economical manner, it becomes ready to cope with a rapidly increasing demand for highly finished aluminium discs and to cut down on their production cost by the increase in working efficiency. Considering the above, the impact on the related industries is very great.

What is claimed is:

1. A composite whetstone for polishing soft metals comprising matrix and fine abrasive particle, characterized in that said matrix forms a three-dimensional network structure with continuous fine voids therein and is composed uniformly of a polyvinyl acetal-based polymer, a hardened product of at least one kind of thermosetting plastic and amorphous silicate, said fine abrasive particle is incorporated into said matrix fixed substantially in close contact with each other in a continuous manner, and the superficial hardness (H) of said composite whetstone and the size (G) of said fine abrasive particle satisfy a relation $$-180 \leqq H + G/55 \leqq -50,$$

where H is a value obtained from the measurement by a Rockwell hardness tester with the superficial 15-Y scale and G is a value obtained from the classification according to Japanese Industrial Standard (JIS) R-6001.

2. A composite whetstone for polishing soft metals as set forth in claim 1, in which said matrix contains 0.1–10% by weight of said amorphous silicate based upon the weight of said matrix.

3. A composite whetstone for polishing soft metals as set forth in claim 1 or 2, in which said thermosetting plastic comprises at least one kind of polymer selected from the group consisting of a melamine-based resin, and a phenol-based resin.

4. A composite whetstone for polishing soft metals as set forth in any one claims 1 or 2, in which said fine abrasive particle comprises at least one kind of abrasive selected from the group comsisting of silicon carbide, fused alumina, chromium oxide and cerium oxide.

5. A composite whetstone for polishing soft metals as set forth in claim 4 wherein said fine abrasive particle is at least one kind of abrasive selected from the group consisting of silicon carbide, fused alumina, chromium oxide and cerium oxide.

6. A composite whetstone for polishing soft metals as set forth in claim 1 wherein said continuous fine voids have a diameter in the range of from 10 to 100 microns.

7. A composite whetstone for polishing soft metals as set forth in claim 6 wherein said matrix has a porosity of from 60 to 85% by volume.

8. A composite whetstone for polishing soft metals as set forth in claim 1 wherein said amorphous silicate is a gel-like inorganic polymer of formula

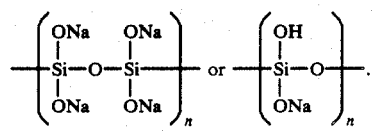

9. A composite whetstone for polishing soft metals as set forth in claim 1 wherein said amorphous silicate is an aluminosilicate.

10. A composite whetstone for polishing soft metals as set forth in claim 1 wherein said fine abrasive particle is at least grade #800 and is present in said composite in an amount of at least 25% by weight, based upon the weight of the whole matrix.

11. The composite whetstone of claim 10 wherein the amount of said abrasive particle is at least 35% by weight.

* * * * *